US006917296B2

(12) United States Patent
Mayusumi et al.

(10) Patent No.: US 6,917,296 B2
(45) Date of Patent: Jul. 12, 2005

(54) FIRE HEAT SENSOR

(75) Inventors: Kari Mayusumi, Toyko (JP); Yukio Yamauchi, Kanagawa-ken (JP); Hiroshi Shima, Kanagawa-ken (JP)

(73) Assignee: Hochiki Corporation (JP)

( * ) Notice: Subject to any disclaimer, the term of this patent is extended or adjusted under 35 U.S.C. 154(b) by 0 days.

(21) Appl. No.: 10/253,616

(22) Filed: Sep. 25, 2002

(65) Prior Publication Data

US 2003/0063005 A1 Apr. 3, 2003

(30) Foreign Application Priority Data

Sep. 28, 2001 (JP) ..... 2001-299253

(51) Int. Cl.[7] ..... G08B 17/00
(52) U.S. Cl. ..... 340/584; 340/693.6; 374/29
(58) Field of Search ..... 340/584, 693.6, 340/693.5, 693, 588, 589, 577; 374/29, 208, 129, 134; 73/204.26, 204.11, 204.17, 118.2

(56) References Cited

U.S. PATENT DOCUMENTS 4,929,093 A * 5/1990 Suzuki et al. ..... 374/208
5,450,066 A 9/1995 Brighenti et al.
5,463,375 A * 10/1995 Bauer ..... 340/517
5,539,381 A 7/1996 Johnson
5,584,579 A * 12/1996 Asano et al. ..... 374/208
5,662,072 A * 9/1997 Suzuki et al. ..... 123/41.14

FOREIGN PATENT DOCUMENTS

| | | | |
|---|---|---|---|
| EP | 1 298 618 | 8/2003 | |
| JP | 1-170954 | 7/1989 | |
| JP | 1-297795 | 11/1989 | |
| JP | 10-332496 | 12/1998 | |
| JP | 10-332496 A | * 12/1998 | ..... 340/584 |
| JP | 11-64116 | 3/1999 | |

OTHER PUBLICATIONS

European Search Report dated Jun. 20, 2003.

* cited by examiner

*Primary Examiner*—Anh V. La
(74) *Attorney, Agent, or Firm*—Blank Rome LLP

(57) ABSTRACT

A fire heat sensor comprising a high-temperature detecting portion provided with a temperature detecting element which exhibits a fast heat response to a rise in ambient temperature, and a low-temperature detecting portion provided with a temperature detecting element which exhibits a slow heat response to a rise in ambient temperature. The fire heat sensor further comprises a resin member by which the high-temperature detecting portion and the low-temperature detecting portion are integrally formed so that heat energy is transferred from the temperature detecting element of the high-temperature detecting portion to the temperature detecting element of the low-temperature detecting portion. In the fire heat sensor, differential heat sensing is performed based on temperatures detected by the low-temperature detecting portion and the high-temperature detecting portion.

7 Claims, 13 Drawing Sheets

(A)

(B)

PRIOR ART

PRIOR ART

PRIOR ART

FIRE HEAT SENSOR

BACKGROUND OF THE INVENTION

1. Field of the Invention

The present invention relates generally to a fire heat sensor, and more particularly to a fire heat sensor that performs differential heat sensing, i.e., a fire heat sensor that detects a fire by judging the rate of a rise in temperature by a pair of temperature detecting elements and a heat conduction structure thereof.

2. Description of the Related Art

There is a conventional fire heat sensor that performs differential heat sensing. The differential fire heat sensor detects a fire by judging the rate of a rise in temperature caused by the fire. As such a differential fire heat sensor, there are a thermocouple type heat sensor, and a heat sensor employing two thermistors. In addition, there is a temperature sensor employing a fine machining technique for purposes of detecting a sharp change in temperature. These sensors are used to detect a sharp rise in temperature, based on a difference in temperature between two points. To cause the temperature difference to occur, one of the two points has a fast response to heat and the other point has a slow response to heat.

FIG. 13 shows a conventional fire heat sensor with two thermistors as heat sensing elements (see Japanese Laid-Open Patent Publication No. HEI 1-297795). In this type of fire heat sensor, one (thermistor 101) of the two thermistors has a fast response to heat because it is exposed to hot airflow, and serves as a high-temperature detecting portion. The other thermistor 102 has a slow response to heat because it is housed within a cover, and serves as a low-temperature detecting portion.

When the fire heat sensor is exposed to hot airflow, the temperature detected by the first thermistor 101 changes sharply because the heat response is fast. On the other hand, the temperature detected by the second thermistor 102 changes slowly because the heat response is slow. Therefore, a temperature difference signal of a sufficient magnitude is obtained. When it exceeds a predetermined threshold value, the heat sensor can judge the occurrence of a fire.

As described above, in the differential type fire heat sensor, a difference in temperature is detected by two temperature detecting elements having a fast response to heat and a slow response to heat. Because of this, the level of a temperature difference due to a sharp change in temperature caused by a fire cannot be easily discriminated from the level of a temperature difference due to a gradual temperature change. To discriminate between the two levels, signal processing is required.

FIG. 14 shows the principles of a conventional differential fire heat sensor. The temperature detecting element 201 of a high-temperature detecting portion is situated at a position where hot airflow is directly exposed, while the temperature detecting element 202 of a low-temperature detection portion is situated at another position where the hot airflow is screened by a guard member 203.

FIG. 15 shows how a high temperature $T_h$ detected by the high-temperature detecting element 201, a low temperature $T_c$ detected by the low-temperature detecting element 202, and a temperature difference $\Delta T$, are changed when the ambient temperature $T_a$ in FIG. 14 rises sharply. In this case, the high temperature $T_h$ rises sharply, and the low temperature $T_c$ rises slowly. As a result, a great temperature difference $\Delta T$ is obtained.

FIG. 16 shows how the above-described high temperature $T_h$, low temperature $T_c$, and temperature difference $\Delta T$ are changed when the ambient temperature $T_a$ in FIG. 14 rises slowly. In this case, the high temperature $T_h$ rises along with the ambient temperature $T_a$, and the low temperature $T_c$ rises slowly. Because of this, as with the case of the sharp temperature change in FIG. 15, a great temperature difference $\Delta T$ is obtained.

However, in the case of the differential heat sensing in which the occurrence of a fire is judged when the temperature difference $\Delta T$ exceeds a predetermined level TH, the temperature difference $\Delta T$ exceeds the predetermined level TH even when the ambient temperature $T_a$ changes slowly. Because of this, to discriminate a sharp temperature rise from a slow temperature rise, the case of the sharp temperature rise requires a temperature characteristic F ($\Delta T$), as shown in FIG. 15. The case of the slow temperature rise requires a temperature characteristic F ($\Delta T$), as shown in FIG. 16. Because of this, the differential heat sensing circuit becomes complicated.

Furthermore, the high-temperature detecting element 201 and the low-temperature detecting element 202 are situated at asymmetrical positions with respect to the horizontal direction, so the heat response of the low-temperature detecting element 202 varies with the direction of hot airflow. Because of this, the differential heat sensing, based on a difference in temperature, greatly depends on the direction of hot airflow.

SUMMARY OF THE INVENTION

The present invention has been made in view of the circumstances mentioned above. Accordingly, it is the primary object of the present invention is to provide a differential type fire heat sensor which is capable of eliminating the signal processing for discriminating a sharp temperature change from a slow temperature change, and also reducing dependence on the direction of hot airflow.

To achieve this end and in accordance with the present invention, there is provided a fire heat sensor comprising a high-temperature detecting portion provided with a temperature detecting element which exhibits a fast heat response to a rise in ambient temperature, and a low-temperature detecting portion provided with a temperature detecting element which exhibits a slow heat response to a rise in ambient temperature. The fire heat sensor further comprises a resin member by which the high-temperature detecting portion and the low-temperature detecting portion are integrally formed so that heat energy is transferred from the temperature detecting element of the high-temperature detecting portion to the temperature detecting element of the low-temperature detecting portion. In the fire heat sensor, differential heat sensing is performed based on temperatures detected by the low-temperature detecting portion and the high-temperature detecting portion.

The fire heat sensor of the present invention is similar to the above-described conventional structure in that the transfer of heat energy to the high-temperature detecting portion is great and the transfer of heat energy to the low-temperature detecting portion is small. However, in the present invention, heat energy is transferred from high-temperature detecting portion through the resin member and to the low-temperature detecting portion.

Because of this, in the case of a sharp temperature rise due to a fire, temperature rises in a short time and therefore the quantity of the heat energy that is transferred to the low-temperature detecting portion in a short time is small.

Therefore, a great temperature difference is obtained at the time of a sharp temperature rise, and thereafter, a temperature difference is decreased.

On the other hand, in the case of a gradual temperature rise, ambient temperature rises slowly in a longtime. Therefore, the temperature rise of the low-temperature detecting portion follows the rise of the ambient temperature by the transfer of heat energy to the low-temperature detecting portion through the resin member. Therefore, the temperature difference increases slowly and then reaches a fixed value. There is no possibility that the temperature difference will exceed a threshold value for judging a fire.

Furthermore, the transfer of heat energy from the high-temperature detecting portion to the low-temperature detecting portion alleviates the difference between temperature changes due to the direction of hot airflow. As a result, dependence on the direction of hot airflow can be reduced.

In the fire heat sensor of the present invention, a high-temperature detecting part of the resin member equipped with the temperature detecting element of the high-temperature detecting portion may be situated at a position where heat of hot airflow generated by a fire is transferred. A low-temperature detecting part of the resin member equipped with the temperature detecting element of the low-temperature detecting portion may be situated at a position where heat of hot airflow generated by a fire is screened by a guard member.

In the fire heat sensor of the present invention, a high-temperature detecting part of the resin member which is equipped with the temperature detecting element of the high-temperature detecting portion, and a low-temperature detecting part of the resin member which is equipped with the temperature detecting element of the low-temperature detecting portion, may be situated at positions where heat of hot airflow generated by a fire is transferred. The aforementioned low-temperature detecting part of the resin member may be in contact with a heat accumulator whose heat capacity is great.

The fire heat sensor of the present invention may further comprise a heat sensing circuit for judging a fire from a temperature difference between temperatures detected by the high-temperature detecting portion and the low-temperature detecting portion. The temperature detecting elements may comprise transistors. In this case, the heat sensing circuit may constitute a bridge circuit which includes the transistor of the low-temperature detecting portion and the transistor of the high-temperature detecting portion, in order to obtain an output signal which corresponds to a difference between temperatures detected by the high-temperature detecting portion and the low-temperature detecting portion.

In the fire heat sensor of the present invention, the aforementioned temperature detecting elements may comprise diodes, thermistors, or thermocouples.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

Preferred embodiments of the present invention will hereinafter be described in detail with reference to the drawings.

Figure 1:
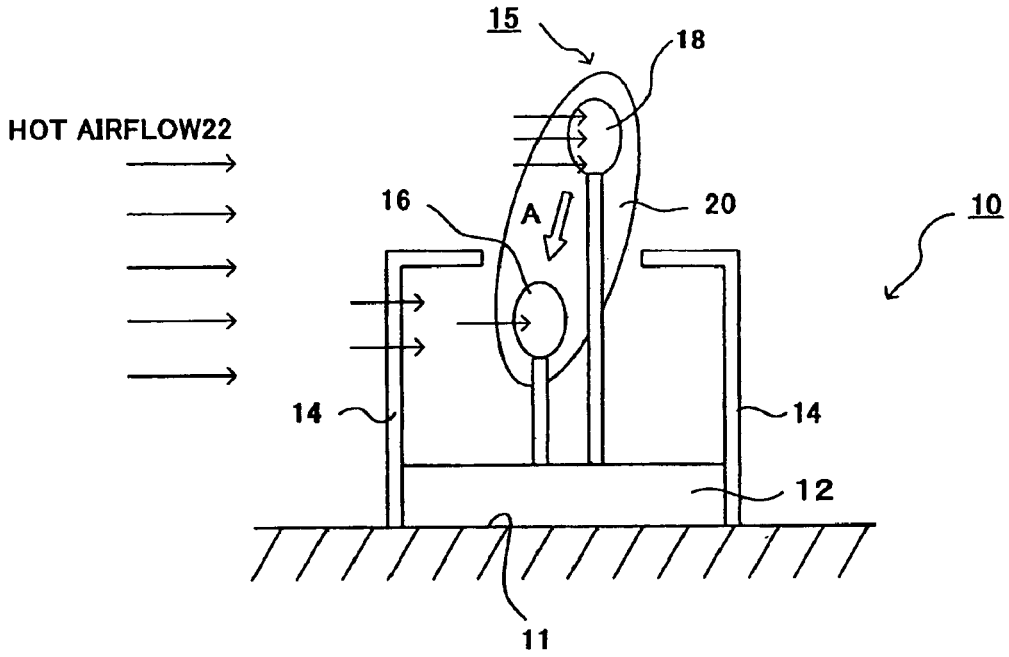
FIG. 1 is a diagram showing a fire heat sensor constructed in accordance with a first embodiment of the present invention.

Referring to FIG. 1, there is depicted a fire heat sensor 10 constructed in accordance with a first embodiment of the present invention. In the figure, the fire heat sensor 10 includes a main body 12, and a guard member 14 formed on the main body 12. The main body 12 is installed on a mounting surface 11 such as a ceiling. The guard member 14 has an opening in which a sensor portion 14 is situated.

The sensor portion 15 has a temperature detecting element 16 which constitutes a low-temperature detecting portion, and a temperature detecting element 18 which constitutes a high-temperature detecting portion. The temperature detecting element 16 and the temperature detecting element 18 are formed integrally with each other by a resin member 20 consisting of synthetic resin such as epoxy resin, etc.

The temperature detecting element 16 which constitutes the low-temperature detecting portion of the sensor portion 15 is situated within the guard member 14 and at a position that is not exposed directly to hot airflow 22. Because of this, the temperature detecting element 16 has a slow response to a rise in ambient temperature and therefore functions the low-temperature detecting portion of the sensor portion 15.

On the other hand, the temperature detecting element 18 which constitutes the high-temperature detecting portion of the sensor portion 15 is situated outside the guard member 14 and is exposed directly to the hot airflow 22. Because of this, the temperature detecting element 18 exhibits a fast response to a rise in ambient temperature and therefore functions the high-temperature detecting portion of the sensor portion 15.

Next, a description will be given of how heat energy flows in the fire heat sensor 10 of FIG. 1 when exposed to the hot airflow 22 caused by a fire. If the fire heat sensor 10 of the present invention undergoes the hot airflow 22 flowing in a direction approximately parallel to the mounting surface 11, the temperature detecting element 18 of the high-temperature detecting portion of the sensor portion 15 receives a great quantity of heat energy, because it is exposed directly to the hot airflow 22.

On the other hand, the temperature detecting element 16 of the low-temperature detecting portion receives a small quantity of heat energy, because the hot airflow 22 is screened by the guard member 14 and heat energy is transferred via the resin member 20.

Figure 14:
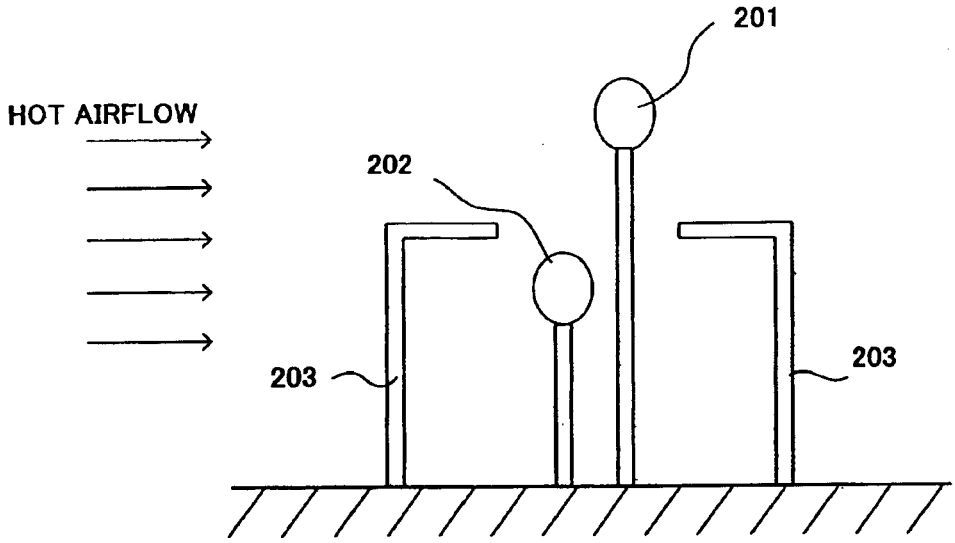
FIG. 14 is a diagram used to show the principles of a conventional differential heat sensor.
Figure 15:
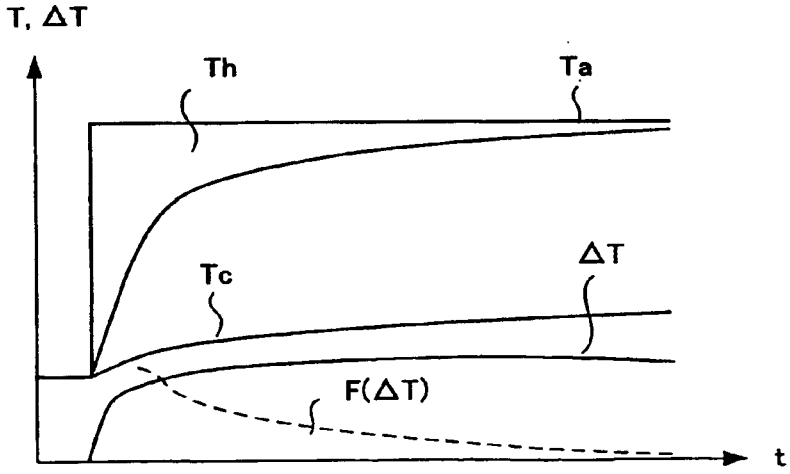
PRIOR ART FIG. 15
FIG. 15 is a graph showing how a high temperature detected by a high-temperature detecting element, a low temperature detected by a low-temperature detecting element, and a difference in temperature, in the conventional structure, are changed when ambient temperature rises sharply.
Figure 16:
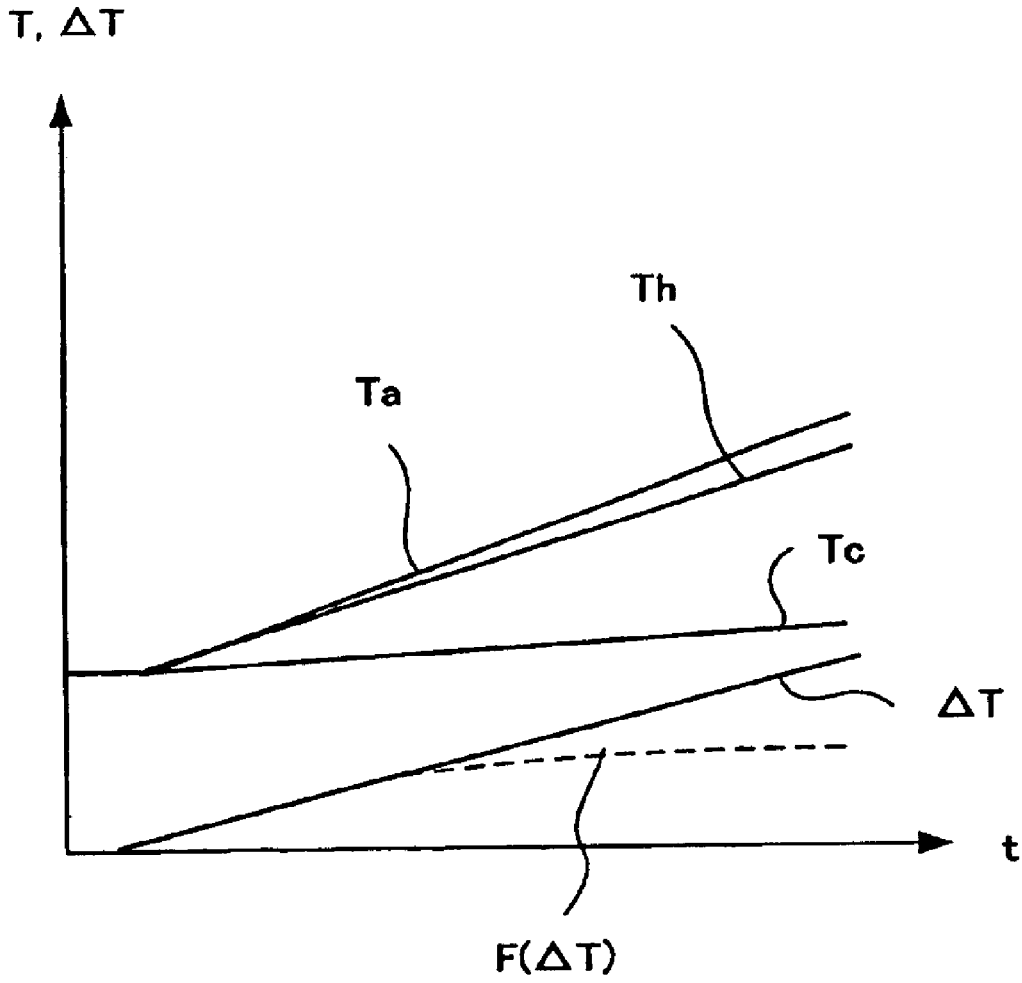
FIG. 16 is a graph showing how the high temperature, the low temperature, and the temperature difference in the conventional structure are changed when the ambient temperature rises slowly.

The transfer of heat energy to the temperature detecting element 18 of the high-temperature detecting portion and the temperature detecting element 16 of the low-temperature detecting portion is basically the same as the conventional structure shown in FIG. 14. However, in the structure of the present invention, heat energy is transferred from the temperature detecting element 18 of the high-temperature detecting portion through the resin member 20 and to the temperature detecting element 16 of the low-temperature detecting portion, as indicated by an arrow A.

At the time of a sharp rise in ambient temperature during afire, temperature rises in a short time and therefore the transfer of heat energy from the high-temperature detecting portion to the low-temperature detecting portion in a short time is small. This case is approximately the same as the case where the temperature detecting portion 18 is connected to the temperature detecting portion 16 without the resin member 20. A temperature difference ΔT in this case is $(T_h-T_c)$, in which $T_h$ is the temperature detected by the temperature detecting portion 18 of the high-temperature detecting portion and $T_c$ is the temperature detected by the temperature detecting portion 16 of the low-temperature detecting portion.

On the other hand, in a gradual temperature rise, ambient temperature rises slowly in a long time and therefore the transfer of heat energy from the high-temperature detecting portion to the low-temperature detecting portion through the resin member 20 is great. Since the high-temperature detection portion is connected with the low-temperature detecting portion through the resin member 20, the temperature $T_c$ detected by the temperature detecting element 16 of the low-temperature detecting portion follows a rise in ambient temperature.

Figure 2:
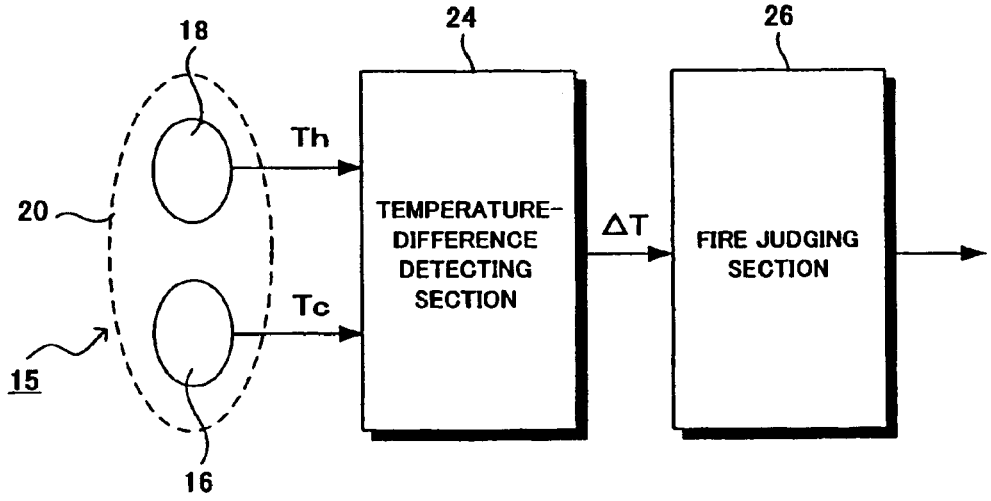
FIG. 2 is a block diagram showing a heat sensing circuit for differential heat sensing, employed in the first embodiment of FIG. 1.

FIG. 2 shows a heat sensing circuit for differential heat sensing, employed in the first embodiment of FIG. 1. The heat sensing circuit includes a temperature-difference detecting section 24 and a fire judging section 26. The temperature-difference detecting section 24 detects a temperature difference $\Delta T (=T_h-T_c)$ between the temperature $T_h$ detected by the temperature detecting element 18 of the high-temperature detecting portion and the temperature $T_c$ detected by the temperature detecting element 16 of the low-temperature detecting portion.

The temperature difference ΔT detected by the temperature-difference detecting section 24 is output to the fire judging section 26. In an actual circuit, the detected temperature difference ΔT from the temperature-difference detecting section 24 is, for example, a voltage signal. The fire judging section 26 compares the detected signal, which corresponds to the temperature difference ΔT from the temperature-difference detecting section 24, with a predetermined threshold value for judging the occurrence of a fire. When the detected signal corresponding to the temperature difference ΔT exceeds the predetermined threshold value, the fire judging section 26 judges the occurrence of a fire and outputs a fire detection signal to an external receiver.

Figure 3:
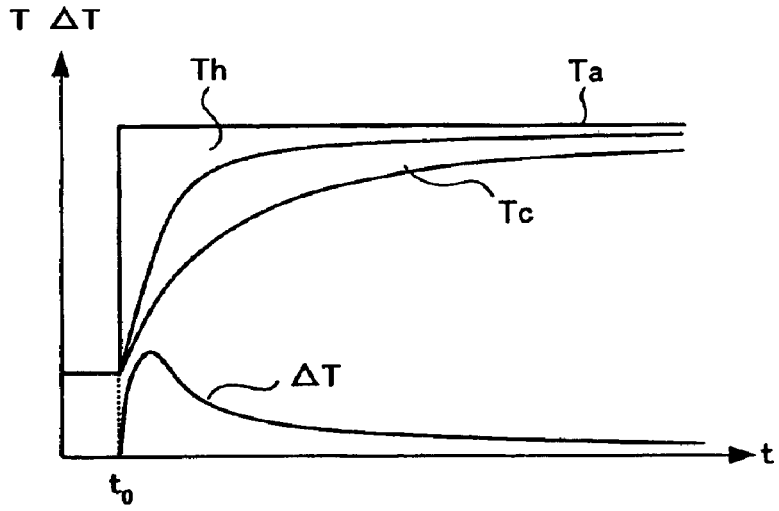
FIG. 3 is a graph showing how the detected high temperature, detected low temperature, and temperature difference in the first embodiment of FIG. 1 are changed when ambient temperature rises sharply.

FIG. 3 shows how the detected high temperature $T_h$, detected low temperature $T_c$, and temperature difference ΔT in the first embodiment of FIG. 1 are changed when ambient temperature $T_a$ rises sharply.

In FIG. 3, when the ambient temperature $T_a$ rises sharply at time t0 so that it changes stepwise, the detected high temperature $T_h$ follows the ambient temperature $T_a$ and rises sharply. On the other hand, the detected low temperature $T_c$ first rises slowly with respect to a sharp change in the ambient temperature $T_a$, but follows the ambient temperature $T_a$ with the lapse of time. Because of this, the temperature difference ΔT, which is calculated from the detected high temperature $T_h$ and the detected low temperature $T_c$, is sharply increased immediately after the ambient temperature $T_a$ rises sharply, and thereafter, it is slowly decreased.

Figure 4:
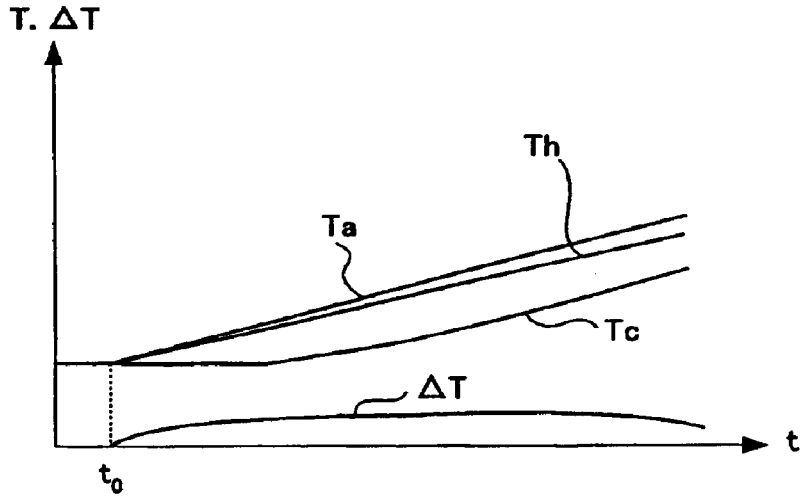
FIG. 4 is a graph showing how the detected high temperature, detected low temperature, and temperature difference in the first embodiment of FIG. 1 are changed when ambient temperature rises slowly.

FIG. 4 shows how the detected high temperature $T_h$, detected low temperature $T_c$, and temperature difference ΔT in the first embodiment of FIG. 1 are changed when ambient temperature $T_a$ rises slowly.

In FIG. 4, ambient temperature $T_a$ is slowly increased at time t0 at a rising gradient. With respect to a slow increase in the ambient temperature $T_a$, the detected high temperature $T_h$ follows the ambient temperature $T_a$ with a slight delay. The detected low temperature $T_c$ follows the ambient temperature $T_a$ with a certain degree of delay, because heat energy is transferred from the high-temperature detecting portion through the resin member 20 and to the low-temperature detecting portion. Because of this, the temperature difference ΔT, which is calculated from the detected high temperature $T_h$ and the detected low temperature $T_c$, increases slowly with the lapse of time and, thereafter, reaches a fixed value.

Thus, the level of the temperature difference ΔT that is obtained at the time of a sharp temperature rise corresponding to the occurrence of a fire of FIG. 3 can be discriminated from the level of the temperature difference ΔT that is obtained at the time of a gradual temperature rise (FIG. 4). Therefore, if a threshold value, for judging the occurrence of a fire based on the temperature difference ΔT that is obtained at the time of a sharp temperature rise, is set at a level exceeding the temperature difference ΔT that is obtained at the time of a slow temperature rise, there can be provided a differential fire heat sensor which is operated not by a slow temperature rise but by a sharp temperature rise at the time of a fire.

Figure 5:
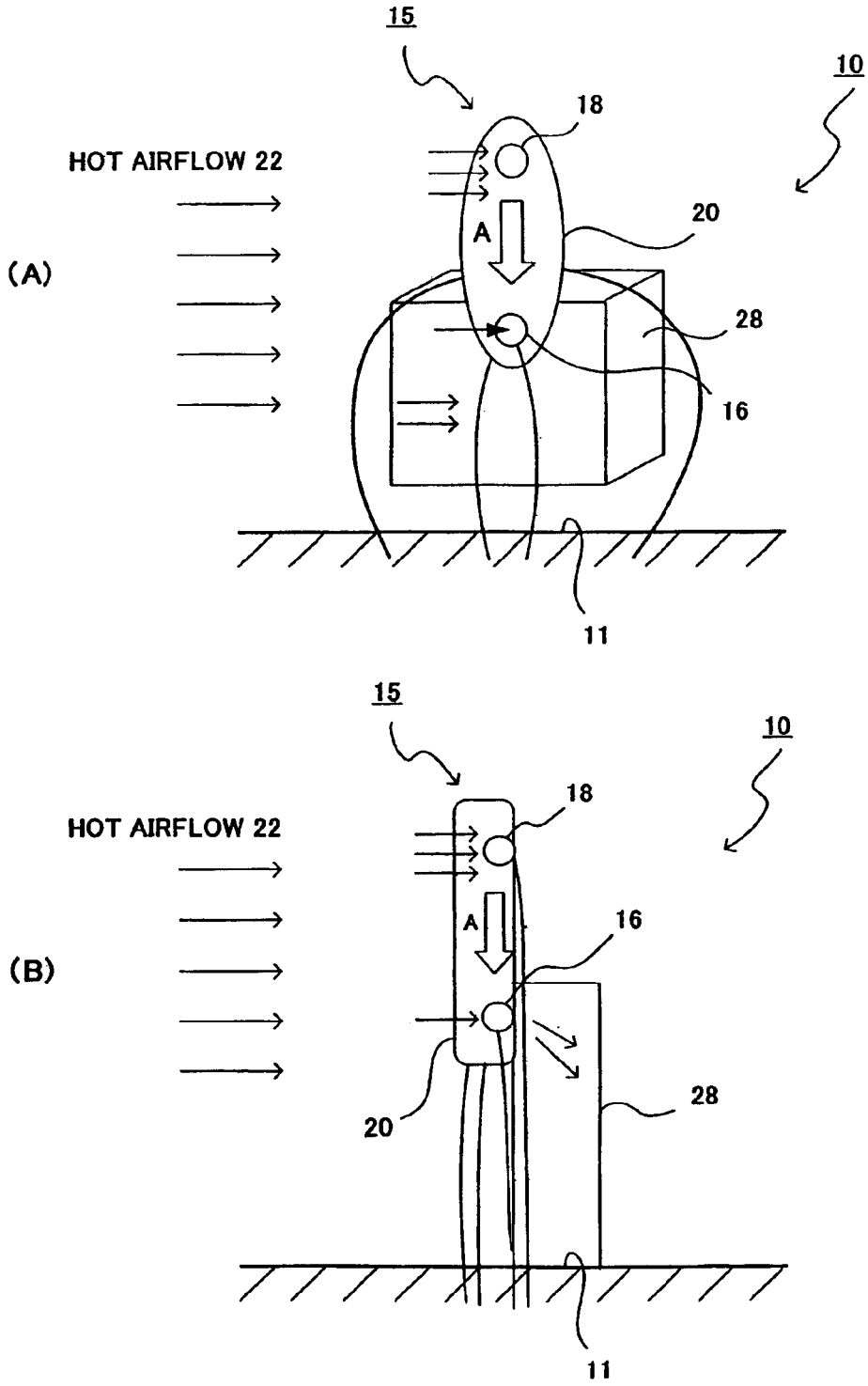
FIG. 5A is a front view showing a fire heat sensor constructed in accordance with a second embodiment of the present invention.
FIG. 5B is a side view of the fire heat sensor shown in FIG. 5A.

FIG. 5 shows a fire heat sensor constructed in accordance with a second embodiment of the present invention. The second embodiment is characterized in that a heat accumulator is provided in a low-temperature detection portion. In FIG. 5A, a sensor portion 15, as with the first embodiment of FIG. 1, includes a temperature detecting element 16 which constitutes a low-temperature detecting portion, and a temperature detecting element 18 which constitutes a high-temperature detecting portion. The temperature detecting elements 16 and 18 are housed integrally in a resin member 20.

The low-temperature detecting portion of the sensor portion 15 provided with the temperature detecting element 16 is in contact with a heat accumulator 28, which is formed from a material whose heat capacity is great. The temperature detecting element 16 and temperature detecting element 18 of the sensor portion 15 are both situated so that they are exposed to hot airflow 22 caused by a fire.

If the sensor portion 15 directly undergoes the hot airflow 22 caused by a fire, the temperature detecting element 18 on the side of the high-temperature detecting portion exhibits a fast response to a rise in ambient temperature, because it is merely housed in the resin member 20. On the other hand, near the temperature detecting element 16 of the low-temperature detecting portion through the resin member 20, there is provided the heat accumulator 28 whose heat capacity is great. Because of this, the temperature detecting element 16 exhibits a slow response to a rise in ambient temperature, because heat energy is absorbed by the heat accumulator 28.

At the same time, the heat energy of the hot airflow 22 is transferred from the temperature detecting element 18 of the high-temperature detecting portion to the temperature detecting element 16 of the low-temperature detecting portion, because they are integrally formed by the resin member 20.

Thus, in the second embodiment of FIG. 5, as with the first embodiment of FIG. 1 provided with the guard member 14, the detected high temperature $T_h$ and the detected low temperature $T_c$ are changed as shown in FIG. 3 when ambient temperature $T_a$ rises sharply. The temperature difference ΔT is sharply increased, and then decreased.

On the other hand, a gradual temperature change is the same as the case where the ambient temperature $T_a$ is slowly increased as shown in FIG. 4. As with the detected high temperature $T_h$, the detected low temperature $T_c$ follows the ambient temperature $T_a$ with a certain degree of delay. The temperature difference ΔT increases slowly and then reaches a fixed value.

Thus, the second embodiment of FIG. 5, as in the first embodiment of FIG. 1, is capable of discriminating a sharp temperature rise from a slow temperature rise and therefore performing differential sensing.

The heat accumulator, provided near the low-temperature detecting portion, may be a circuit board having both a sensor main body and a temperature detecting element. That is, the transfer of heat energy from the low-temperature detecting portion to the structural member may be controlled so that the low-temperature detecting portion exhibits a slow response to a rise in ambient temperature. The quantity of the heat energy from the low-temperature detecting portion to the sensor main body or circuit board can be controlled by suitably adjusting the contact surface between the low-temperature detecting portion and the sensor body (or circuit board), and the width and length of wires.

Figure 6:
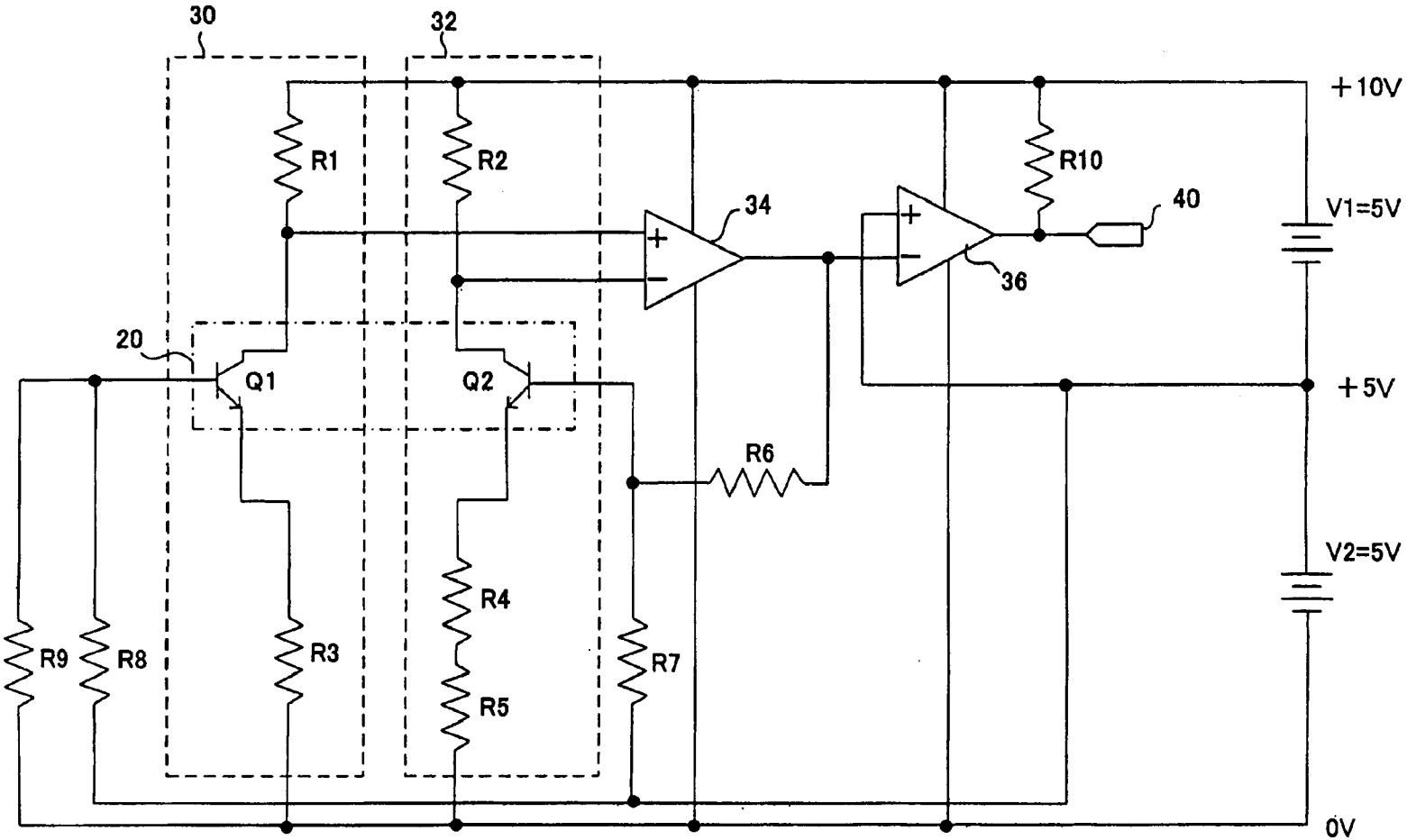
FIG. 6 is a circuit diagram of the heat sensing circuit shown in FIG. 2.

FIG. 6 shows a circuit diagram of the heat sensing circuit shown in FIG. 2. The heat sensing circuit is equipped with a low-temperature detection circuit portion 30 and a high-temperature detection circuit portion 32. The low-temperature detection circuit portion 30 includes a transistor Q1, which corresponds to the temperature detecting element 16 provided in the low-temperature detecting portion of the sensor portion 15. The high-temperature detection circuit portion 32 includes a transistor Q2, which corresponds to the temperature detecting element 18 provided in the high-temperature detecting portion of the sensor portion 15.

Figure 7:
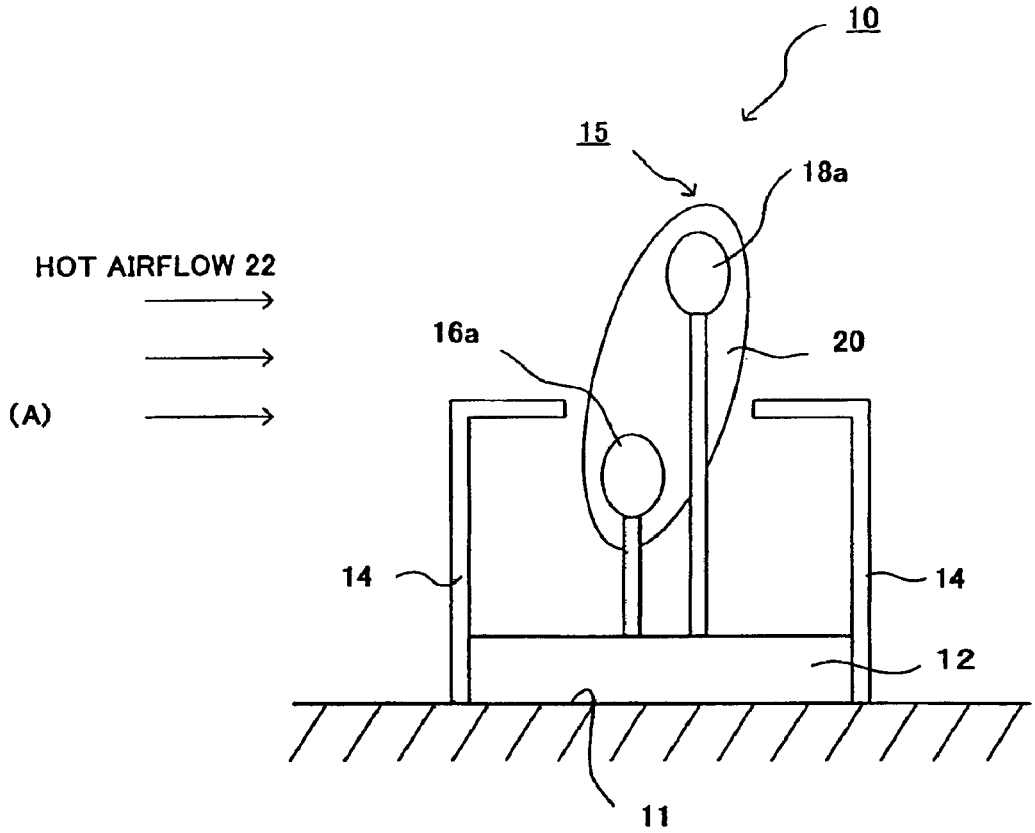
FIG. 7A is a diagram showing a fire heat sensor constructed in accordance with a third embodiment of the present invention.
FIG. 7B is a diagram showing a heat sensing circuit mounted on a printed board.
Figure 7:
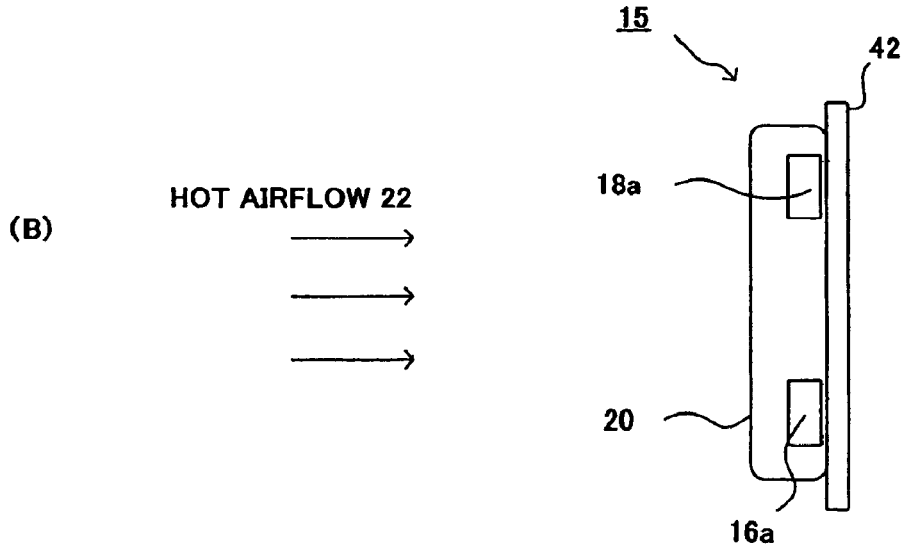

FIG. 7 shows a fire heat sensor employing transistors as the temperature detecting elements 16, 18. In FIG. 7A, a transistor 16*a* is housed in a resin member 20 as a temperature detecting element that is provided in the low-temperature detecting portion of a sensor portion 15. A transistor 18*a* is housed in the resin member 20 as a temperature detecting element that is provided in the high-temperature detecting portion of the sensor portion 15. As shown in FIG. 7B, the resin member 20 is molded with the transistors 16*a* and 18*a* mounted on a printed board 42.

Referring again to FIG. 6, the low-temperature detection circuit portion 30 and the high-temperature detection circuit portion 32 are connected to an operational amplifier 34. The low-temperature detection circuit portion 30 and the high-temperature detection circuit portion 32 constitute abridge circuit when viewed from the operational amplifier 34. This bridge circuit consists of four impedance elements: (R1); (R2); (Q1, R3); and (Q2, R4, R5).

The output of the operational amplifier 34 is input to a comparator 36. The comparator 36 has a reference voltage (threshold voltage) for judging a fire. This circuit is operated by two power sources V1 and V2 and is supplied with a midpoint voltage of 5 V and a circuit voltage of 10 V.

The transistor Q1 in the low-temperature detection circuit portion 30 is biased by the partial voltage of resistors R8 and R9. The transistor Q2 in the high-temperature detection circuit portion 32 is likewise biased by the partial voltage of resistors R6 and R7. Furthermore, the resistor R5 of the high-temperature detection circuit portion 32 is an adjusting resistor for absorbing transistor variations.

Next, operation of the heat sensing circuit of FIG. 6 will be described. Initially, in a fire monitoring state (i.e., in an ordinary temperature state or a room temperature state), a current flowing in the resistor R1, transistor Q1, and resistor R3 of the low-temperature detection circuit portion 30 is equal to a current flowing in the resistor R2, transistor Q2, and resistors R4, R5 of the high-temperature detection circuit portion 32. Therefore, there is no potential difference between the input terminals of the operational amplifier 34.

In this equilibrium state, if the heat sensing circuit receives heat from hot airflow generated by a fire, the heat is transferred to the high-temperature detecting portion of FIG. 1. The base-emitter voltage $V_{be}$ of the transistor Q2 of the high-temperature detection circuit portion 32, which is the temperature detecting element 18 provided in the high-temperature detecting portion of the sensor portion 15, is changed according to the temperature coefficient of the base-emitter junction of a transistor, for example, −2.3 mV/° C.

Because of this, the base current of the transistor Q2 increases. Therefore, the current flowing in the high-temperature detection circuit portion 32 increases and the voltage on the negative input terminal of the operational amplifier 34 decreases. Because of this, the operational amplifier 34 amplifies the potential difference between the input terminals thereof and outputs it to the comparator 36.

That is, assuming the output voltage of the operational amplifier 34 is $V_d$, the output $V_d$ due to a difference in temperature has the following value:

$$V_d = (\text{temperature at a low temperature point} - \text{temperature at a high temperature point}) \times \{(R6+R7)/R7\} \times V_{tc}$$

Next, a description will be given of the adjusting resistor R5 that absorbs variations in the transistors provided in the high-temperature detection circuit portion 32. In the embodiment of FIG. 6, the operating point of the sensor is adjusted at the single resistor R5 in consideration of component variations, utilizing a single reference voltage.

The resistors R1 to R5 and transistors Q1 and Q2 of the low-temperature detection circuit portion 30 and high-temperature detection circuit portion 32 have device variations, respectively. Therefore, when they are not adjusted, the output of the operational amplifier 34 does not become 5 V (midpoint potential).

The voltage across the series circuit of the low-temperature detection circuit portion 30, which consists of the resistor R2, transistor Q1, and resistor R3, is 10 V in total. The positive input terminal of the operational amplifier 34 has a voltage higher than the base voltage of the transistor Q1 by the voltage $V_c$ between the collector and the base. The base voltage of the transistor Q1 is always smaller in a voltage dividing circuit (which consists of resistors R8 and R9) than 5 V (which is the midpoint voltage) by a value equal to 5V×R8/(R8+R9).

In this state, if the resistor R5 is adjusted, a current that flows in the resistor R2, transistor Q2, and resistors R4 and R5 of the high-temperature detection circuit portion 32 can be varied. Therefore, by adjusting the value of the resistor R5, the voltage on the negative input terminal of the operational amplifier 34 can be adjusted so that it coincides with the voltage on the positive input terminal. In this way, device variations can be absorbed.

In the embodiment of FIG. 6, the output of the operational amplifier 34 is connected to the comparator 36 that has a midpoint potential of 5V as a reference voltage. The output of the operational amplifier 34 is compared with the midpoint potential 5V.

When the resistor R5 is adjusted so that the output of the operational amplifier 34 is 4V, and the amplification degree of the operational amplifier 34 is set to about 87 times, $$V_d = (-2.3\ \text{mV}) \times (-1) \times 87 = 0.2\ \text{V},$$

if the difference in temperature between the high-temperature detecting portion and the low-temperature detecting portion is 1° C. Therefore, the output of the operational amplifier 34 is changed 0.2 V per 1° C. (temperature difference).

If the temperature difference between the high-temperature detecting portion and the low-temperature detecting portion is 5° C. or greater, the output of the operational amplifier 34 becomes 5V or greater. Therefore, if the output of the operational amplifier 34 exceeds the reference voltage 5V of the comparator 36, the output of the comparator 36 is inverted and a fire detection signal can be output from an output terminal 40 to an external unit.

Figure 8:
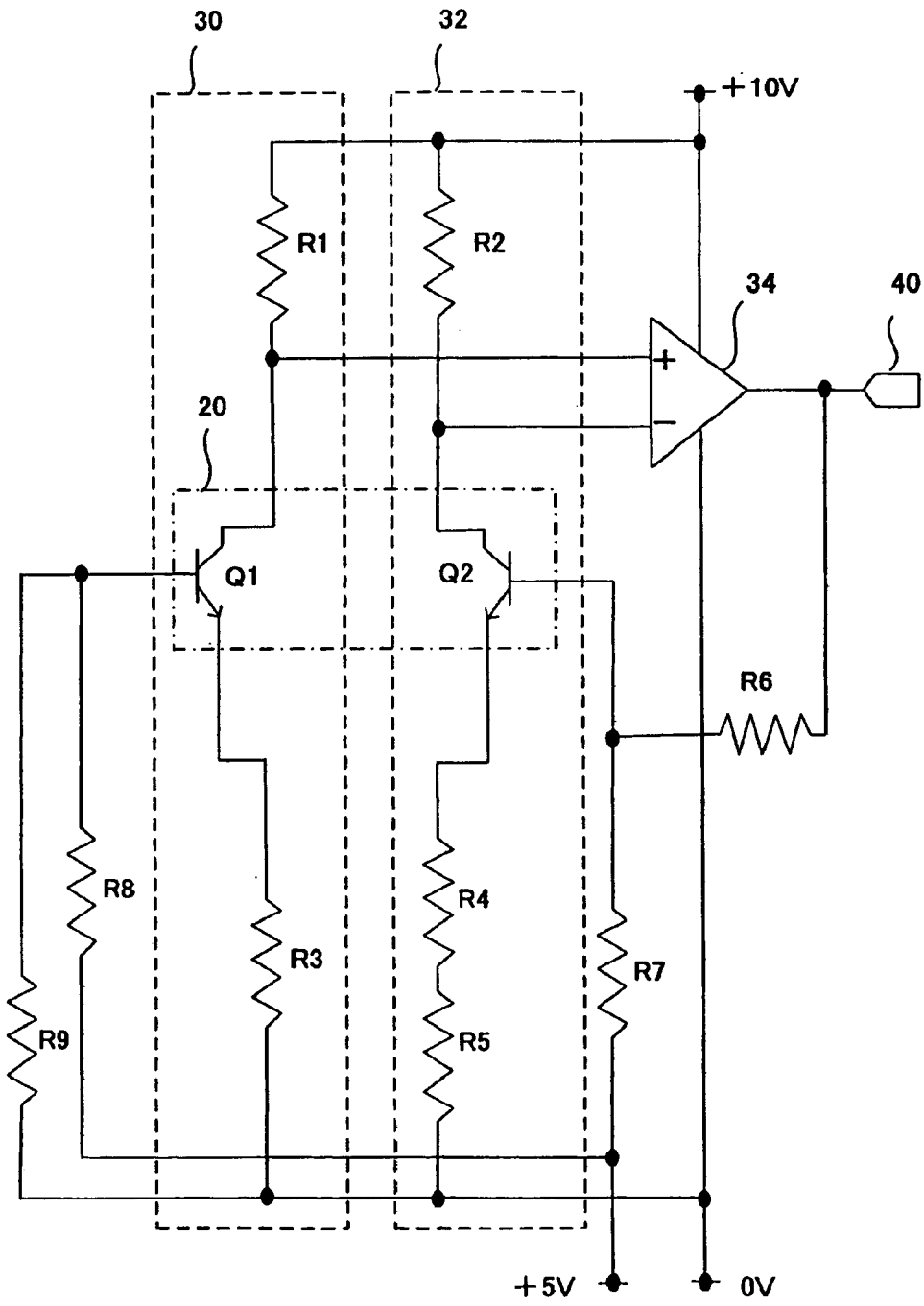
FIG. 8 is a circuit diagram showing another embodiment of the heat sensing circuit of the present invention.

FIG. 8 shows another embodiment of the heat sensing circuit of the present invention. In this embodiment, a low-temperature detection circuit portion 30, a high-temperature detection circuit portion 32, and an operational amplifier 34 are mounted on the side of the printed board 42 shown in FIG. 7. The comparator 36 and subsequent circuits, shown in FIG. 6, are provided on the side of the main body 12 of FIG. 1. If the heat sensing circuit portion of FIG. 8 is mounted on the printed board 42 of FIG. 7 in which the transistors 16*a* and 18*a* are formed integrally with the resin member 20, the size of the fire heat sensor can be reduced as shown in FIG. 7B.

Figure 9:
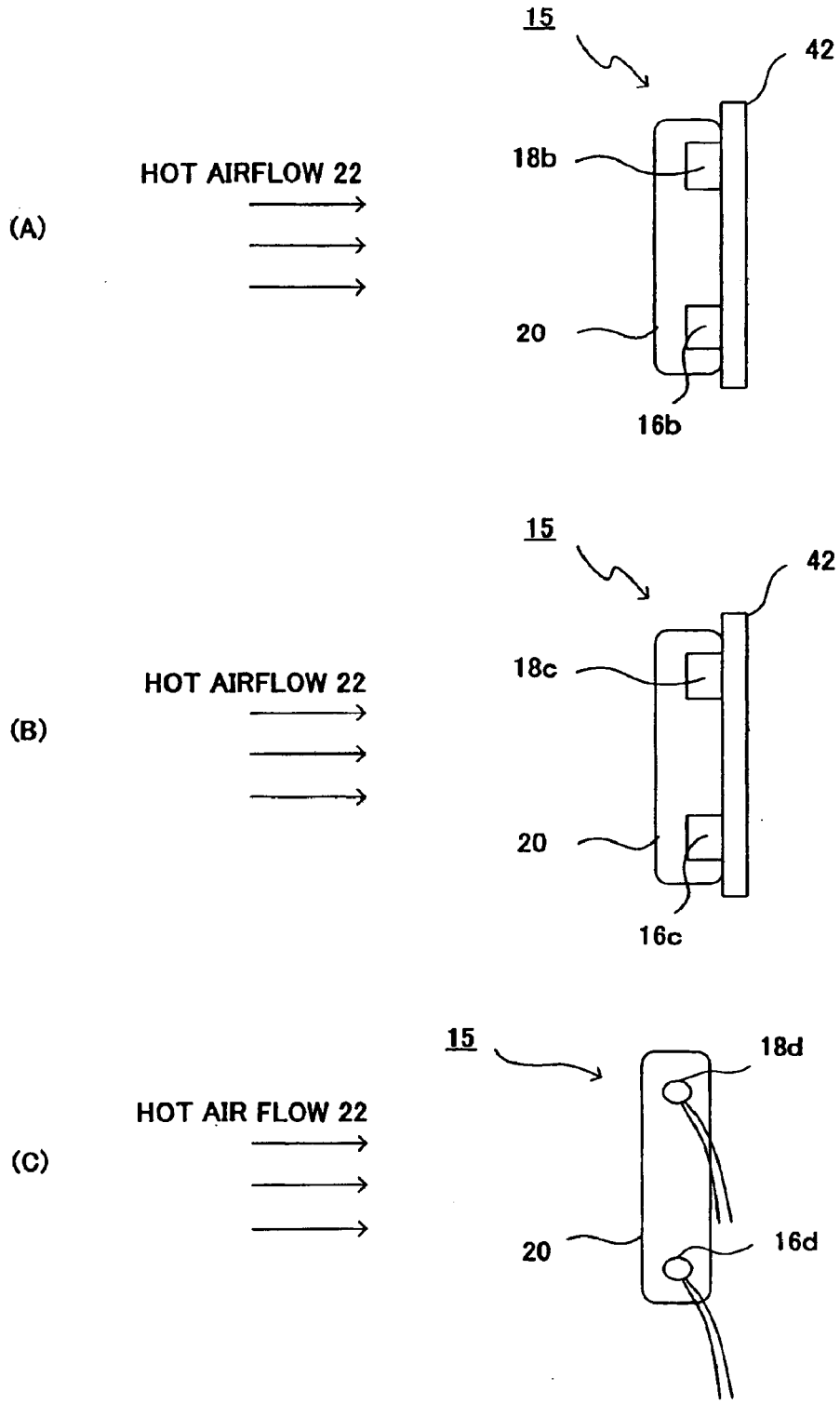
FIG. 9A is a diagram showing a fire heat sensor constructed in accordance with a fourth embodiment of the present invention.
FIG. 9B is a diagram showing a fire heat sensor constructed in accordance with a fifth embodiment of the present invention.
FIG. 9C is a diagram showing a fire heat sensor constructed in accordance with a sixth embodiment of the present invention.

FIG. 9 shows embodiments in which diodes, thermistors, and thermocouples are employed as the temperature detecting elements of the high-temperature and low-temperature detecting portions of the sensor portion 15.

In the embodiment of FIG. 9A, a diode 18*b* which becomes the temperature detecting element of the high-temperature detecting portion of a sensor portion 15 is mounted on the printed board 42 of the sensor portion 15. A diode 16*b* which becomes the temperature detecting element of the low-temperature detecting portion is mounted a predetermined distance away from the diode 18*b*. The diodes 16*b* and 18*b* and the printed board 42 are integrally formed by a resin member 20 consisting of epoxy resin.

In the embodiment of FIG. 9B, thermistors are employed as the temperature detecting elements. As with the embodiment of FIG. 9A, a thermistor 18*c* for high-temperature detection and a thermistor 16*c* for low-temperature detection are spaced a predetermined distance and mounted on a printed board 42. The thermistors 16*c* and 18*c* and the printed board 42 are integrally formed by a resin member 20 consisting of epoxy resin.

In the embodiment of FIG. 9C, thermocouples are employed as the temperature detecting elements. A thermocouple 18*d* for high-temperature detection and a thermocouple 16*d* for low-temperature detection are spaced a predetermined distance and mounted on a printed board 42. The thermocouples 16*d* and 18*d* and the printed board 42 are integrally formed by a resin member 20 consisting of epoxy resin.

In the sensor portions 15 of FIGS. 9A, B, and C in which diodes, thermistors, and thermocouples are employed as the temperature detecting elements, a sharp temperature change due to a fire can be discriminated from a gradual temperature change, if as shown in FIG. 1, the low-temperature detecting portion is situated on the side of the guard member 14, or if as shown in FIG. 5, the low-temperature detecting portion is in contact with the heat accumulator 28 whose heat capacity is great.

Figure 10:
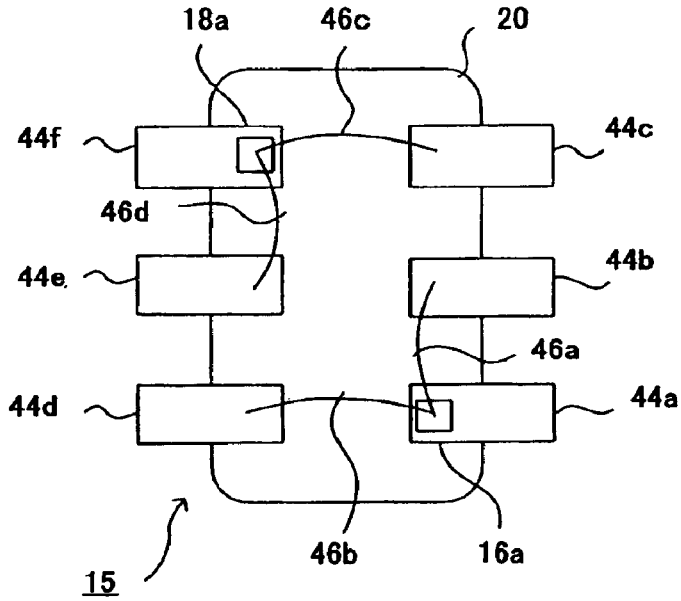
FIG. 10A is a diagram showing a sensor portion constructed in accordance with a seventh embodiment of the present invention.
FIG. 10B is a diagram of the sensor portion mounted on a printed board.
Figure 10:
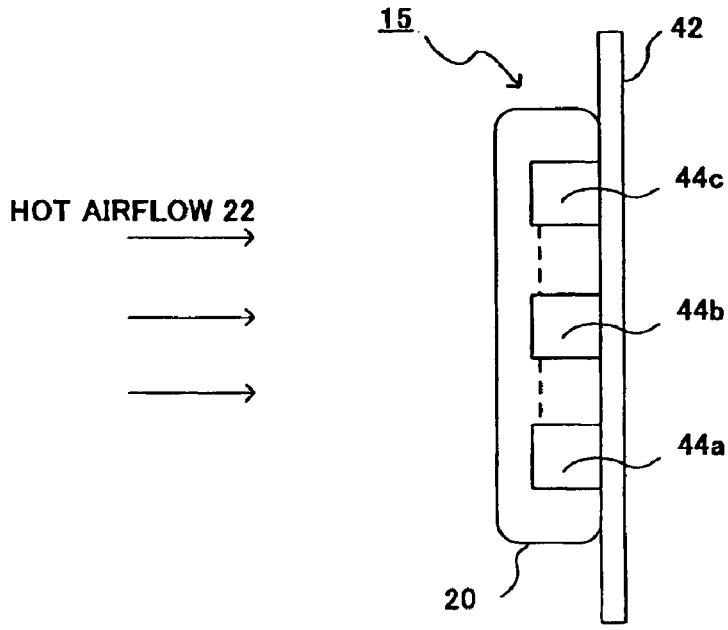

FIG. 10 shows a sensor portion constructed in accordance with a seventh embodiment of the present invention. As shown in FIG. 10A in the sensor portion 15, a transistor 16*a* for low-temperature detection and a transistor 18*a* for high-temperature detection are provided as the temperature detecting elements. The sensor portion 15 has 6 (six) lead terminals 44*a* to 44*f*, which correspond to the collectors, emitters, and bases of the two transistors 16*a* and 18*a*. These components are formed as a package device by a resin member 20 molded.

The collector of the transistor 16*a* of the low-temperature detection portion is connected directly to the lead terminal 44*a*. The emitter lead 46*a* of the transistor 16*a* is connected to the lead terminal 44*b*. The base lead 46*b* of the transistor 16*a* is connected to the lead terminal 44*d*.

The collector of the transistor 18*a* of the high-temperature detection portion is connected directly to the lead terminal 44*f*. The emitter lead 46*c* of the transistor 18*a* is connected to the lead terminal 44*c*. The base lead 46*d* of the transistor 18*a* is connected to the lead terminal 44*e*.

The sensor portion 15 with a package device structure housing two transistors 16*a* and 18*a* is mounted on a printed board 42 shown in FIGS. 10A and 10B by lead terminals 44*a* to 44*f* and constitutes the heat sensing circuit shown in FIG. 6 or 8. The structure for installing the sensor portion 15 of the fire heat sensor uses either the structure of FIG. 1 employing the guard member 14 or the structure of FIG. 5 employing the heat accumulator 28.

Figure 11:
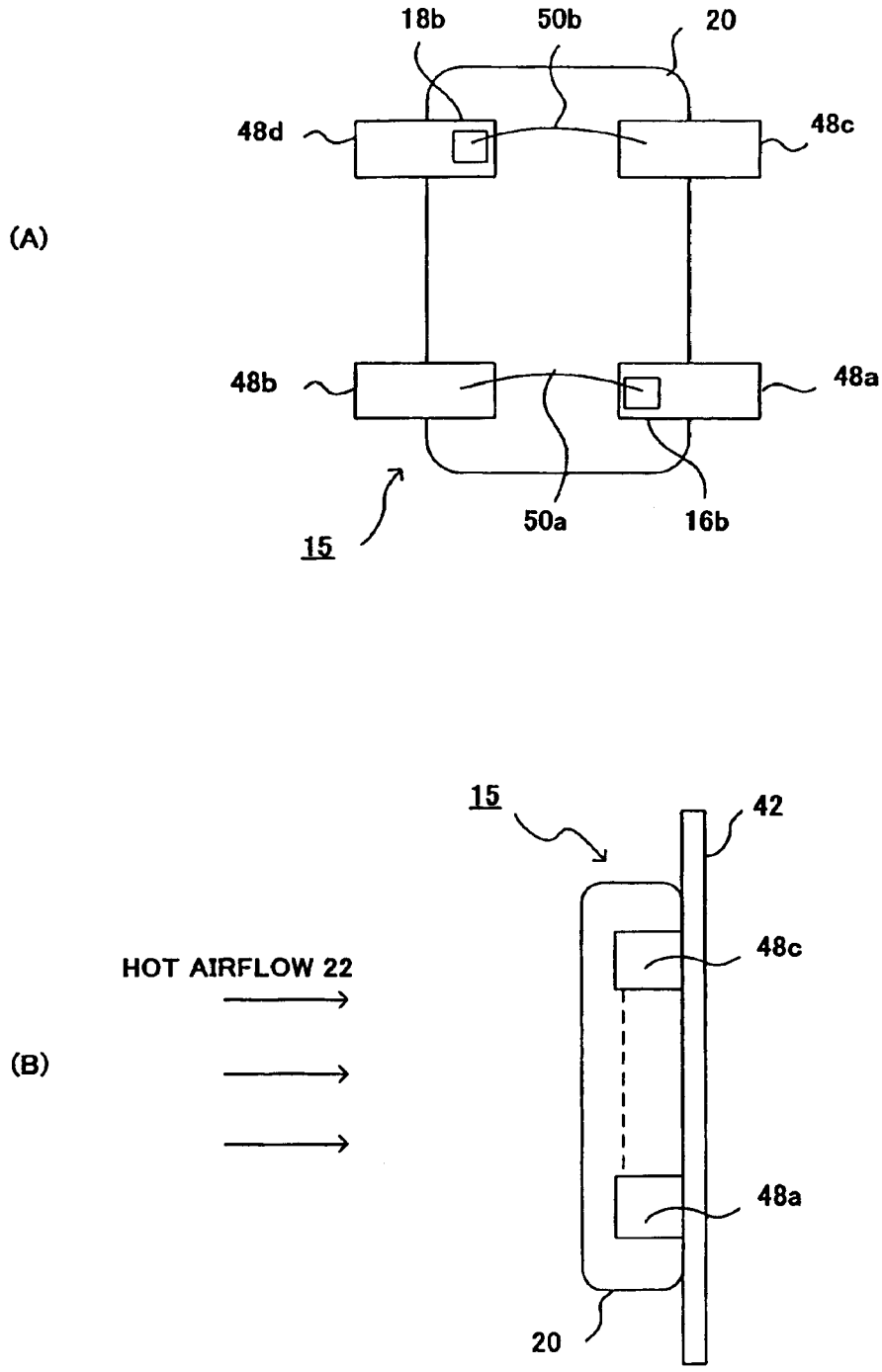
FIG. 11A is a diagram showing a sensor portion constructed in accordance with an eighth embodiment of the present invention.
FIG. 11B is a diagram of the sensor portion mounted on a printed board.

FIG. 11 shows a sensor portion constructed in accordance with an eighth embodiment of the present invention. In the package device structure of this embodiment, as shown in FIG. 11A, a diode 16*b* for low-temperature detection, a diode 18*b* for high-temperature detection, and a resin member 20 are formed as a package device structure by resin molding. When molding the resin member 20, four lead terminals 48*a* to 48*d* are integrally molded.

The cathode of the diode 16*b* of the low-temperature detecting portion of the sensor portion 15 is connected directly to the lead terminal 48*a*, while the anode is connected to the lead terminal 48*b* through a lead 50*a*. The cathode of the diode 18*b* of the high-temperature detecting portion of the sensor portion 15 is connected directly to the lead terminal 48*d*, while the anode is connected to the lead terminal 48*c* through a lead 50*b*.

The sensor portion 15 with a package device structure housing the two transistors 16*b* and 18*b* is mounted on a printed board 42 shown in FIGS. 11A and 11B by the lead terminals 48*a* to 44*d*. If the sensor portion 15 mounted on the printed board 42 is situated as shown in FIG. 1 or 5, the fire heat sensor of the present invention can be obtained.

While the present invention is applied to the above-described package device structure employing two diodes as temperature detecting elements, the invention is also applicable to a package device structure employing thermistors, and a package device structure employing thermocouples.

Figure 12:
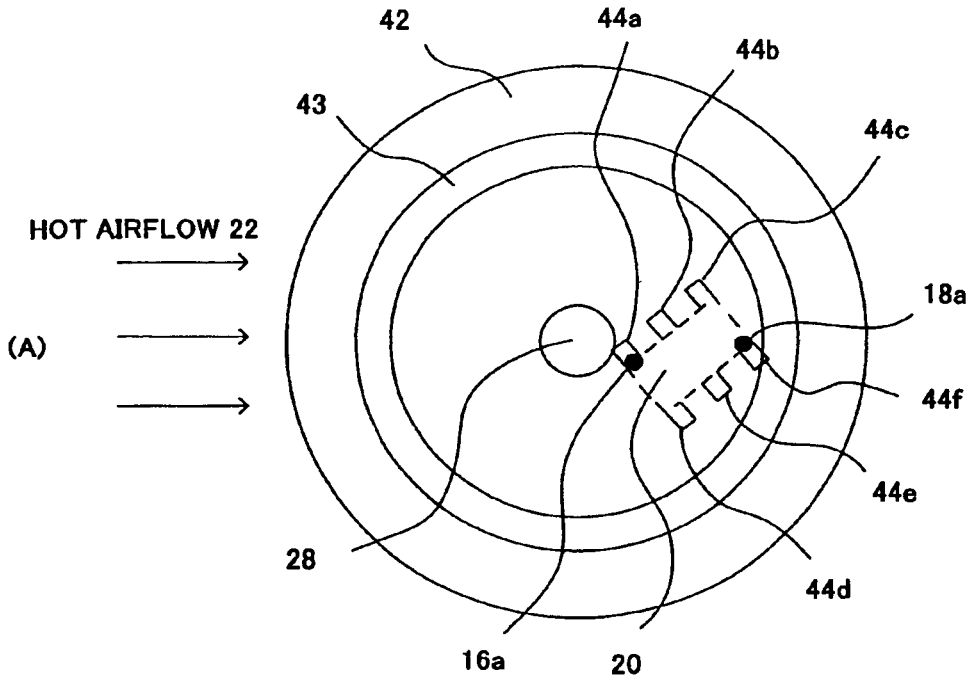
FIG. 12A is a plan view showing a fire heat sensor constructed in accordance with a ninth embodiment of the present invention.
FIG. 12B is a side view of the fire heat sensor shown in FIG. 12A.
Figure 12:
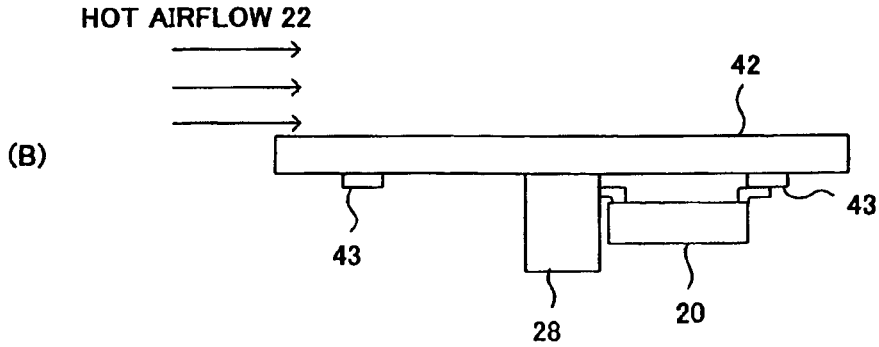
Figure 13:
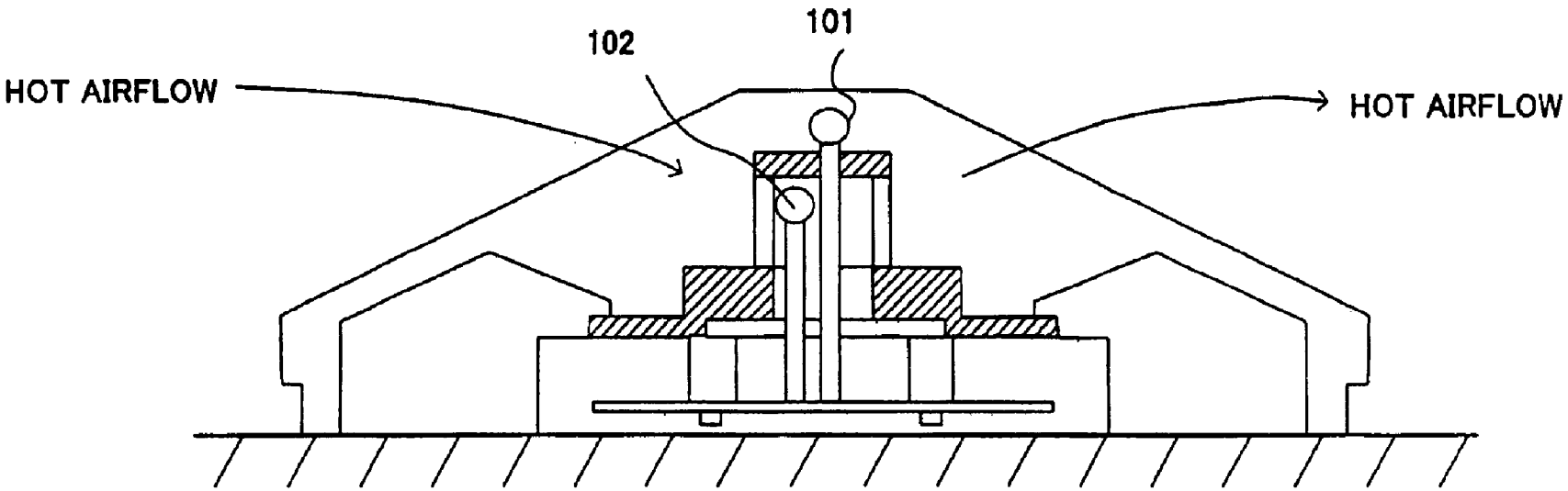
FIG. 13 is a sectional side view showing a conventional fire heat sensor with two thermistors.

FIG. 12 shows a fire heat sensor constructed in accordance with a ninth embodiment of the present invention. This sensor includes a low-temperature detecting portion which has a heat accumulator 28 at approximately the center of a printed board 42, and a high-temperature detection portion which has a ring-shaped heat collector 43. The sensor further includes a resin member 20 by which the temperature detecting element of the low-temperature detecting portion and the temperature detecting element of the high-temperature detecting portion are integrally formed.

In this embodiment, since the high-temperature detection portion has the ring-shaped heat collector 43 whose thermal diffusivity is $10^{-6}$ to $10^{-3}$ ($m^2/s$), there is no possibility that a rise in temperature will depend upon the direction of hot airflow 22. The resin member 20 for integrally forming the temperature detecting elements may use a composite transistor, in which two transistors 16*a* and 18*a* are formed by resin molding, such as that shown in FIG. 10.

For example, among two transistors 16*a* and 18*a* formed within a composite transistor by resin molding, the lead terminal 44*a* of the transistor 16*a* is connected to the heat accumulator 28 and employed as the temperature detecting element for low-temperature detection. The lead terminal 44*f* of the other transistor 18*a* is connected to the heat collector 43 and employed as the temperature detecting element for high-temperature detection. In this way, the bridge circuit shown in FIG. 8 can be constituted. Therefore, this embodiment is capable of outputting a signal which corresponds to the temperature difference between the high-temperature detecting portion and low-temperature detecting portion of the sensor portion 15.

In FIGS. 7 to 9, the hot airflow 22 flows in the right direction, but even in the case where the hot airflow 22 flows in the left direction, and the transfer of heat is made through the printed board, the same temperature rise as the aforementioned embodiments is obtained. The reason is that if the printed board undergoes hot airflow, heat is transferred quickly to the printed board, because the board is thin.

While each of the above-described embodiments is used as a single fire heat sensor, it may be used as a composite fire sensor by providing the fire heat sensor of the present invention in the existing photoelectric smoke sensors.

As set forth above, the present invention has the following advantages:

In accordance with the present invention, the temperature detecting elements and the resin member are integrally formed so that heat energy is transferred from the high-temperature detecting portion through the resin member and to the low-temperature detecting portion. With this structure, the heat response of the low-temperature detecting portion is made sufficiently slow when temperature rises sharply at the time of a fire. On the other hand, in the case of a gradual temperature rise, the temperature detected by the low-temperature detecting portion follows ambient temperature after a certain degree of delay and reaches a fixed value. Therefore, a temperature difference which is obtained from a sharp temperature rise at the time of a fire can be discriminated from a temperature difference which is obtained from a gradual temperature rise. As a result, the signal processing for discriminating the temperature differences can be eliminated and differential heat sensing can be performed with a simple detection structure.

In addition, the transfer of heat energy from the high-temperature detecting portion to the low-temperature detecting portion alleviates the difference between temperature changes due to the direction of hot airflow. As a result, dependence on the direction of hot airflow can be reduced.

While the present invention has been described with reference to the preferred embodiments thereof, the invention is not to be limited to the details given herein. As this invention may be embodied in several forms without departing from the spirit of the essential characteristics thereof, the present embodiments are therefore illustrative and not restrictive. Since the scope of the invention is defined by the appended claims rather than by the description preceding them, all changes that fall within the metes and bounds of the claims, or equivalence of such metes and bounds thereof are therefore intended to be embraced by the claims.

What is claimed is:

1. A fire heat sensor comprising:

a high-temperature detecting portion provided with a temperature detecting element which exhibits a fast heat response to a rise in ambient temperature;

a low-temperature detecting portion provided with a temperature detecting element which exhibits a slow heat response to a rise in ambient temperature; and a resin member by which said high-temperature detecting portion and said low-temperature detecting portion are integrally formed so that heat energy is transferred from the temperature detecting element of said high-temperature detecting portion to the temperature detecting element of said low-temperature detecting portion;

wherein differential heat sensing is performed based on temperatures detected by said low-temperature detecting portion and said high-temperature detecting portion; and said low-temperature detecting portion and said high-temperature detecting portion are ambient temperature oriented so that said differential heat sensing of said high-temperature detecting potion tends to receive more heat energy than said low-temperature detecting portion.

2. The fire heat sensor as set forth in claim 1, wherein:

a high-temperature detecting part of said resin member equipped with the temperature detecting element of said high-temperature detecting portion is situated at a position where heat of hot airflow generated by a fire is transferred; and a low-temperature detecting part of said resin member equipped with the temperature detecting element of said low-temperature detecting portion is situated at a position where heat of hot airflow generated by a fire is screened by a guard member.

3. The fire heat sensor as set forth in claim 1, wherein:

a high-temperature detecting part of said resin member which is equipped with the temperature detecting element of said high-temperature detecting portion, and a low-temperature detecting part of said resin member which is equipped with the temperature detecting element of said low-temperature detecting portion, are situated at positions where heat of hot airflow generated by a fire is transferred; and said low-temperature detecting part of said resin member is in contact with a heat accumulator whose heat capacity is great.

4. The fire heat sensor as set forth in claim 1, further comprising a heat sensing circuit for judging a fire from a temperature difference between temperatures detected by said high-temperature detecting portion and said low-temperature detecting portion;

wherein said temperature detecting elements comprise transistors;

and wherein said heat sensing circuit constitutes a bridge circuit which includes the transistor of said low-temperature detecting portion and the transistor of said high-temperature detecting portion, in order to obtain an output signal which corresponds to a difference between temperatures detected by said high-temperature detecting portion and said low-temperature detecting portion.

5. The fire heat sensor as set forth in claim 1, wherein said temperature detecting elements comprise diodes, thermistors, or thermocouples.

6. The fire heat sensor as set forth in claim 2, wherein said temperature detecting elements comprise diodes, thermistors, or thermocouples.

7. The fire heat sensor as set forth in claim 3, wherein said temperature detecting elements comprise diodes, thermistors, or thermocouples.

* * * * *